US007645146B2

(12) United States Patent
Lindkamp et al.

(10) Patent No.: US 7,645,146 B2
(45) Date of Patent: Jan. 12, 2010

(54) CIRCUIT BOARD CONNECTOR EXTENSION

(75) Inventors: Marc Lindkamp, Luebbecke (DE); Andreas Kohler, Minden (DE); Gert Havermann, Wallenhorst (DE); Dieter Rose, Rahden (DE)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 11/676,982

(22) Filed: Feb. 20, 2007

(65) Prior Publication Data

US 2007/0197088 A1 Aug. 23, 2007

(30) Foreign Application Priority Data

Feb. 21, 2006 (DE) ..... 10 2006 008 015

(51) Int. Cl.
*H01R 12/00* (2006.01)

(52) U.S. Cl. ..... 439/79; 439/924.1; 439/951

(58) Field of Classification Search ..... 439/60, 439/75, 79, 80, 516, 637, 885, 924.1, 951
See application file for complete search history.

(56) References Cited

U.S. PATENT DOCUMENTS

| | | | | |
|---|---|---|---|---|
| 4,687,267 | A | 8/1987 | Header et al. | |
| 4,715,820 | A * | 12/1987 | Andrews et al. | 439/59 |
| 5,647,749 | A * | 7/1997 | Atoh et al. | 439/79 |
| 5,711,679 | A | 1/1998 | Spickler et al. | |
| 5,785,557 | A | 7/1998 | Davis | |
| 5,993,263 | A * | 11/1999 | Sampson | 439/660 |
| 6,319,022 | B1 * | 11/2001 | Hwang | 439/79 |
| 6,733,307 | B2 * | 5/2004 | Wu | 439/79 |
| 6,899,546 | B2 | 5/2005 | Longueville et al. | 439/64 |
| 6,926,542 | B2 * | 8/2005 | Li | 439/79 |
| 7,044,752 | B2 * | 5/2006 | Olson et al. | 439/79 |
| 7,108,520 | B1 * | 9/2006 | Delaney et al. | 439/79 |
| 7,273,381 | B2 | 9/2007 | Ito | 439/79 |
| 2004/0121624 | A1 | 6/2004 | Longueville et al. | |
| 2005/0176268 | A1 | 8/2005 | Zaderej et al. | |

FOREIGN PATENT DOCUMENTS

| | | |
|---|---|---|
| DE | 1 864 359 | 12/1962 |
| JP | 2-148579 | 12/1990 |
| JP | 3050768 | 5/1998 |
| JP | 2007-149643 | 6/2007 |

OTHER PUBLICATIONS

DE Translation of JP OA, dated Jul. 7, 2009 (3 pgs).

* cited by examiner

*Primary Examiner*—Thanh-Tam T Le
(74) *Attorney, Agent, or Firm*—Hayes Soloway P.C.

(57) ABSTRACT

A circuit board connector extension comprising a body made of plastic and able to be attached to a circuit board, with first and second groups of contacts which each have one connecting end for contacting conductor tracks on the circuit board and one plug-in end for contacting contacts of a connector piece, the connecting ends of the two groups of contacts being arranged on one and the same side of the body, whereas the plug-in ends of the first group being arranged on a side of the body difference from that where the plug-in ends of the second group are arranged.

35 Claims, 14 Drawing Sheets

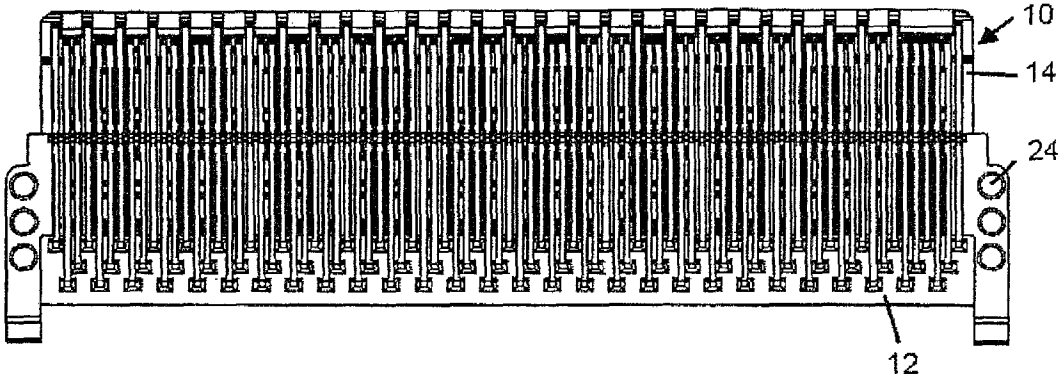
Fig. 29
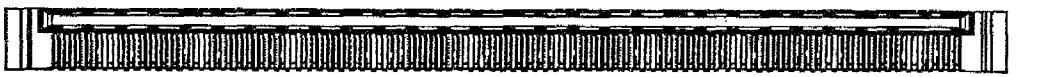
Fig. 26
Fig. 27
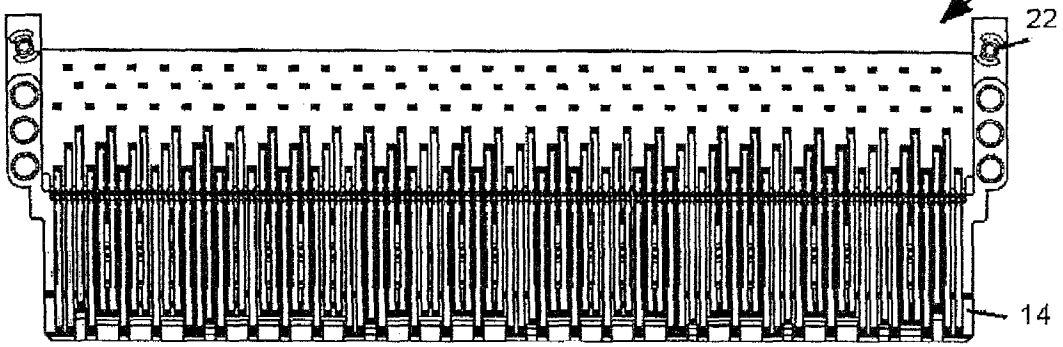
Fig. 28

CIRCUIT BOARD CONNECTOR EXTENSION

The invention generally relates to the field of connecting a circuit board to another circuit board, mostly a so-called backplane. The invention relates in particular to a circuit board connector extension.

It is known to insert a circuit board directly in a connector assembly, e.g. a board edge connector assembly. In doing so, conductor tracks laid in the edge area of the circuit board are contacted directly. The problem with this is in particular that circuit boards generally are manufactured with quite large tolerances. A tolerance of ±10% concerning the thickness is usual, for instance. This results in the problem that with a circuit board ranging at the lower end of the tolerance the connector assembly which receives the circuit board nevertheless has to ensure sufficiently high contact forces, whereas with a circuit board ranging at the upper end of the tolerances the risk of damaging the spring contacts must be prevented and, moreover, high insertion forces are to be avoided.

It is already known, for instance from U.S. Pat. No. 6,899,546, to use a circuit board connector extension which is put onto an edge area of the circuit board and includes contacts which make contact which the conductor tracks arranged there. The connector extension, in turn, can be inserted in a suitable connector assembly. With this solution it is disadvantageous, on the one hand, that a comparably large installation space is required, as the circuit board connector extension surrounds the circuit board on both sides. It is further of disadvantage that a special connector assembly is required for receiving the connector extension, because its thickness is larger than that of the circuit board.

It is the object of the invention to provide a circuit board connector extension which needs little space and can be inserted in a conventional board edge connector piece.

In order to solve this problem, there is provided according to the invention a circuit board connector extension comprising a body made of plastic and able to be attached to a circuit board, with first and second groups of contacts which each have one connecting end for contacting conductor tracks on the circuit board and one plug-in end for contacting contacts of a connector piece, the connecting ends of the two groups of contacts being arranged on one and the same side of the body, whereas the plug-in ends of the first group being arranged on a side of the body different from that where the plug-in ends of the second group are arranged. The solution according to the invention is based on the fundamental idea to "reproduce" on the circuit board connector that area of the circuit board which serves for contacting the conductor tracks, but to improve it at the same time. This relates in particular to the dimensions and tolerances. A plastic part, in contrast to a circuit board, can be fabricated with a precision of few hundredths of a millimeter. In this way the variance of the insertion forces during inserting the connector extension in the associated connector piece can be reduced. It is in particular the connector extension which can be manufactured with dimensions which are at the lower end of the admissible tolerance field. In this way a further reduction of the insertion forces will appear. Furthermore, that area of the connector extension which serves for making contact, is situated in the same plane as the circuit board. The circuit board thus can be guided and inserted in the conventional manner. There will appear very slim dimensions as well, because the contacts of the connector extension are connected with the circuit board from one side only, whereas the plug-in ends lie at both sides of the connector extension.

It is preferred that the body has at least one positioning protrusion, preferably a cylindrical pin, which for positioning the connector extension can be inserted in a mount of the circuit board with an interlocking fit. This allows to attach the circuit board connector extension with precise alignment to the circuit board, which is of particular importance if several circuit boards are combined to form a group.

The positioning protrusion preferably is a cylindrical pin. Such pin can easily be inserted in a hole in the circuit board.

It is preferably provided that between the contacts the body is provided with a group of punched openings which allow the contacts to be blanked. This allows to punch the contacts, which have to be passed through the body of the connector extension, in such a manner that for the time being they still are connected through a material strap. This facilitates the handling. It is not until after assemblage on the body of the connector extension that the material straps are removed, by the openings of the body being penetrated by a suitable tool. The contacts will then be separated from each other.

It is preferably provided that the plug-in ends of the contacts end at different levels. This will ensure that not all spring contacts of the connector piece, into which the connector extension will be inserted, are deflected at the same time, but stepwise. In this way the insertion force is reduced.

It is preferably provided that incisions are provided in front of those plug-in ends which end at a level which is situated further to the rear as seen in the plug-in direction. The incisions serve for guiding the spring contacts of the connector piece to the plug-in ends of the contacts which lie further to the rear. The guidance prevents the spring contacts from accidentally gliding to neighboring contacts. The guidance of the spring contacts is further improved if oblique pilot chamfers are provided at the front end of the incisions.

Preferably, provision is made that air pockets are provided between the contacts and the body. The air pockets allow to adjust the impedance of the contacts in the desired way. In this arrangement, additional air pockets can be provided at the foremost end of the plug-in ends, ahead of the area where the spring contacts of the connector piece will engage.

It is preferably provided that the body integrally consists of two sections which overlap each other, and that the contacts are guided from the first section to the second section by means of a transition portion which is bent approximately at right angles. This shape of the body results in a particularly compact structure. The transition portion of the contacts further can be utilized in an advantageous way for fastening the contacts themselves as well as for suitably pre-tensioning the plug-in ends. To this end, the plug-in ends of the contacts are not bent so as to be exactly perpendicular to the transition portion, but depending on the arrangement at an angle which is slightly larger or smaller than 90°. It is not until the final process of pushing the transition portion into the correct position that the contacts will be bent to an angle of 90° relative to the transition portion; in this process, the resultant elastic pretension can be used to suitably press the plug-in ends into a mount associated to them.

It is preferably provided that the transition portion is configured so as to have a reduced width, so that latching hooks can be formed which approximately have the width of the contacts. Reducing the width of the transition portions allows to be able to bend the contacts in this area with smaller force. The latching hooks determine with their dimensions the more or less close arrangement with which the contacts can be punched out of a material web. In case the latching hooks are formed in an area with reduced width, the contacts ultimately can be punched out so as to lie closer to each other.

It is preferably provided that the contacts of the first group have the connecting ends of the ground contacts lying at one level, the connecting ends of the signal contacts as seen as from the plug-in ends are arranged behind this level, the connecting ends of the ground contacts of the contacts of the second group lie behind the connecting ends of the signal contacts, and behind these the connecting ends of the signal contacts of the second group are arranged. Thus, the ground contacts of the two groups of contacts serve for shielding between the signal contacts of the two groups, improving the crosstalk attenuation.

It is preferably provided that that spacers are arranged between the connector extensions which are laterally inserted in the latter, and that one locating pin each extends through the spacers and the lateral areas of the connector extensions. The spacers make it possible to assembly several circuit boards and the associated circuit board connector extensions to assembly units, so that several circuit boards can be simultaneously pushed into the corresponding backplane connector pieces.

As an alternative provision is made that the spacers are integrally formed on the circuit board connector extensions. In this arrangement, each of the spacers is provided with a retaining pin and two positioning openings. These one-piece design reduces the manufacturing and assembly expenditures and the occurring tolerances, too.

The invention a so relates to a backplane which comprises several backplane connector pieces and several circuit boards with circuit board connector extensions, which are composed with the spacers to form an assembly unit.

Advantageous configurations of the invention will be apparent from the sub-claims.

The invention will now be described on the basis of various embodiments which are illustrated in the attached drawings in which:

FIG. 26 shows top view of a circuit board connector extension according to a further alternative design;

FIG. 27 is a rear view of the circuit board connector extension of FIG. 26;

FIG. 28 is a bottom view of the circuit board connector extension of FIG. 26; and FIG. 29 is a side view of the circuit board connector extension of FIG. 26.

Figure 1:
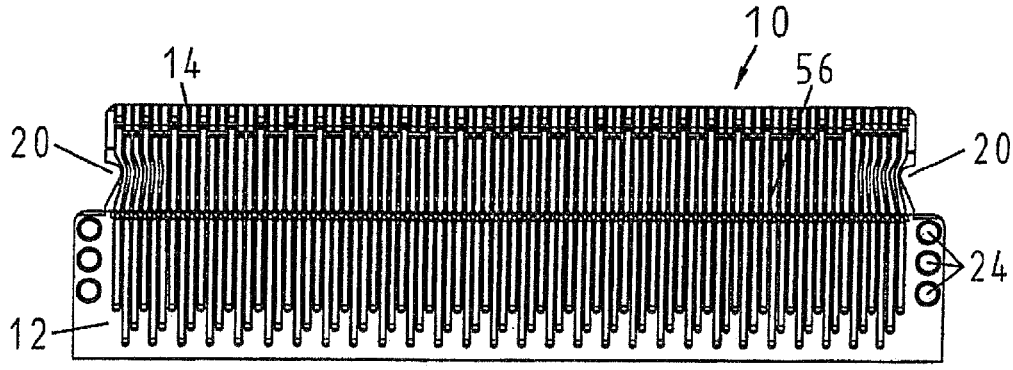
FIG. 1 is top view of a circuit board connector extension according to the invention.
Figure 2:
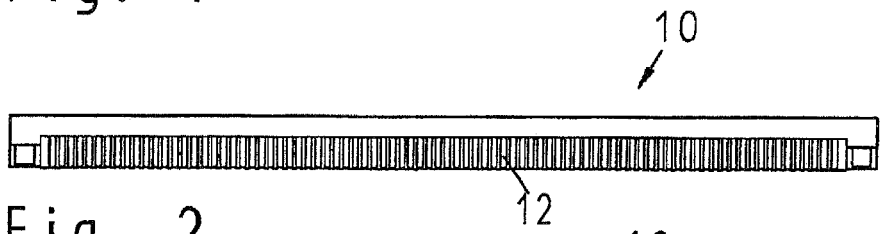
FIG. 2 is a rear view of the circuit board connector extension of FIG. 1.
Figure 3:
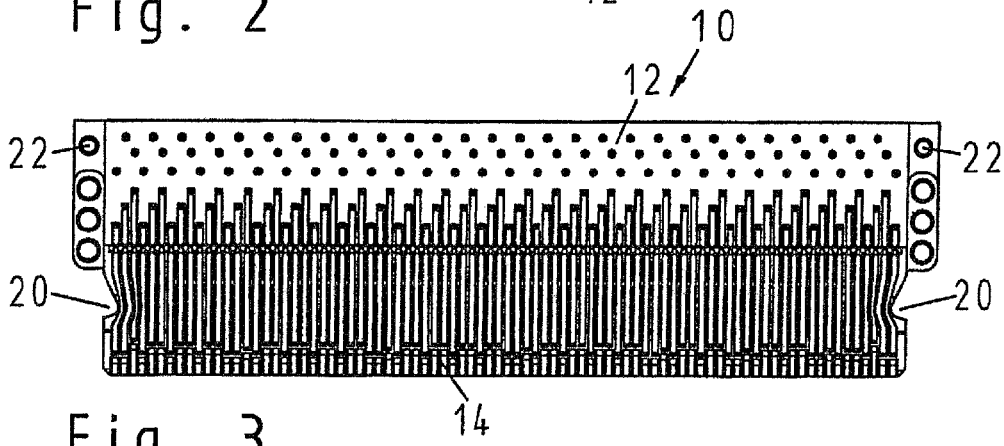
FIG. 3 is a bottom view of the circuit board connector extension of FIG. 1.
Figure 4:
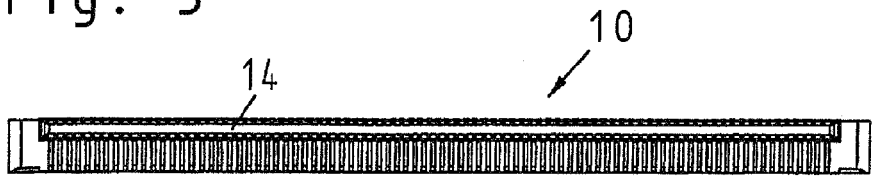
FIG. 4 is a front vie of the circuit board connector extension of FIG. 1.
Figure 5:
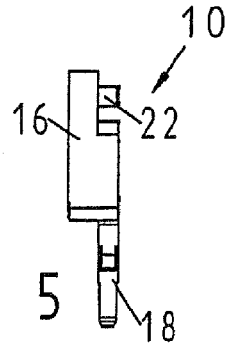
FIG. 5 is a side view of the circuit board connector extension of FIG. 1.

On the basis of FIGS. 1 to 6, first the general structure of a circuit board connector extension 10 according to the invention will now be described. The circuit board connector extension 10 is provided to be attached at the edge of a circuit board in such a manner that a part of the circuit board connector extension projects away from the circuit board. For fastening and contacting the circuit board connector extension on the circuit board, a connecting area 12 is provided on the circuit board connector extension 10; located opposite the connecting area 12 is a plug-in area 14 which is provided for being inserted in a connector assembly in order to connect the circuit board. The connecting area 12 is formed on a first section 16 of the circuit board connector extension 10, and the plug-in area 14 is formed on a second section 18 (see in particular FIG. 5). The two sections 16, 18 generally have a rectangular shape and overlap each other in the middle of the circuit board connector extension 10. Thus, the circuit board connector extension 10 has a stepped shape as viewed from the side. The two sections 16, 18 are integrally formed with each other and consist of plastic which car be molded with very high precision, in particular can be injection-molded.

The plug-in area 14 on the second section 18 is configured in the nature of a wide, generally rectangular tongue, two contractions 20 being laterally provided. These may serve for locking the circuit board connector extension 10—and with it the circuit board attached thereto—on a connector assembly. In the area of the contractions 20 the contacts make an inward curve.

The first section 16 is configured so as to have a somewhat larger thickness than the second section 18 and has at each of its lateral edges a positioning protrusion 22 in the form of a cylindrical pin. The positioning protrusion 22 is used to hold the circuit board connector extension 10 in a precisely defined position on a circuit board. In the vicinity of the positioning protrusions 22 the first section 16 has three openings 24 in total, the function of which will be described later.

The circuit board connector extension is equipped with two groups of contacts, which extend from the connecting area 12 to the plug-in area 14. A first group of contacts 26 extends with a plug-in end 28 along the second section 18, then as transition portion 30 towards the first section 16, and then as connecting end 32 again away from the first section 16. A second group of contacts 27 extends with a plug-in end 28 along that side of the second section 18 which faces away from the plug-in ends 28 of the contacts 26 of the first group, then by means of a transition portion 30 at the lower side of the first sections 16, and then by means of a bent connecting end 32 through the first section 16 to the connecting area 12. The contacts 26 of the first group therefore differ from the contacts 27 of the second group essentially in that the contacts 26 of the first group always remain at the same side of the body 16, 18 of the circuit board connector extension 10, i.e. related to the illustration of FIG. 6 on the upper side, whereas the contacts 27 of the second group traverse the section 16 once. Again related to the illustration of FIG. 6, the plug-in ends 28 of the contacts 27 of the second group are arranged on the lower side of the circuit board connector extension, whereas the connecting ends 32 are located on the upper side.

For improving the shielding provision is made that those contacts of a group, the connecting ends 32 of which have the smallest distance from the transition portions 30, are used as ground contacts. These ground contacts are designated in FIGS. 6 and 11 with M. Such an arrangement shows the result that the rest of the connecting ends 32 of the contacts 26 of the first group are separated from the plug-in area by means of the connecting ends 32, serving a ground conductors, of the contacts 26, and from the connecting ends 32 of the ground conductors of the contacts 27 of the second group of the rest of their connecting ends which are used as signal conductors.

After punching, the contacts 26 of the first group can simply be arranged on the body 16, 18 by using e.g. their connecting ends 32 for transport. With respect to the contacts 27 of the second group, this is somewhat catchier in the realization, because the connecting ends 32 of the contacts 27 have to be put through the first section 16. This is why provision is made for the handling of the contacts 27 that these still remain connected by material straps after punching. In this way only one single formation has to be handled, consisting of a multiplicity of integrally connected contacts. It is not until attaching the contacts 27 to the circuit board connector extension 10 that the material straps are removed. To this end, small punched openings 56 are provided in the second section 18 and can be penetrated by a stamping tool when it removes between the contacts 27 the material straps provided at these places.

Figure 6:
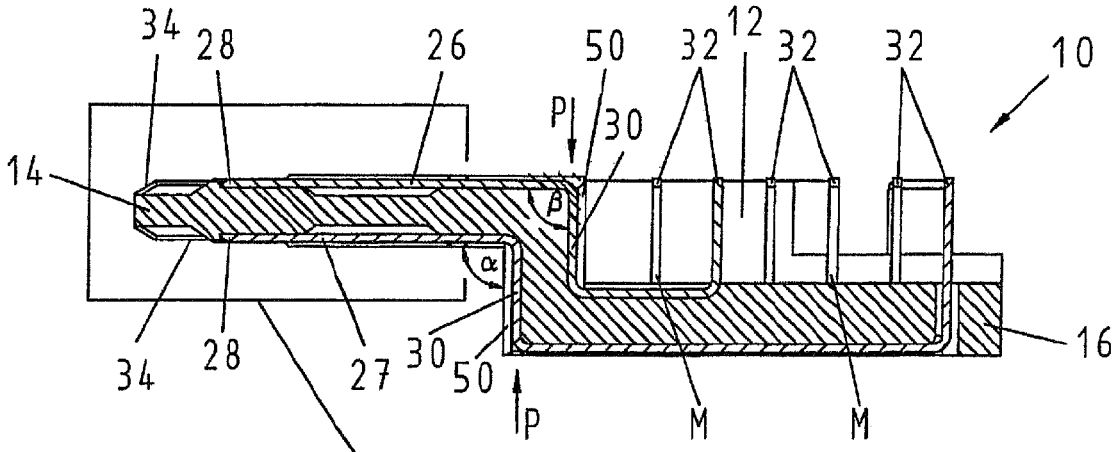
FIG. 6 is a section through the circuit board connector extension of FIG. 1.
Figure 8:
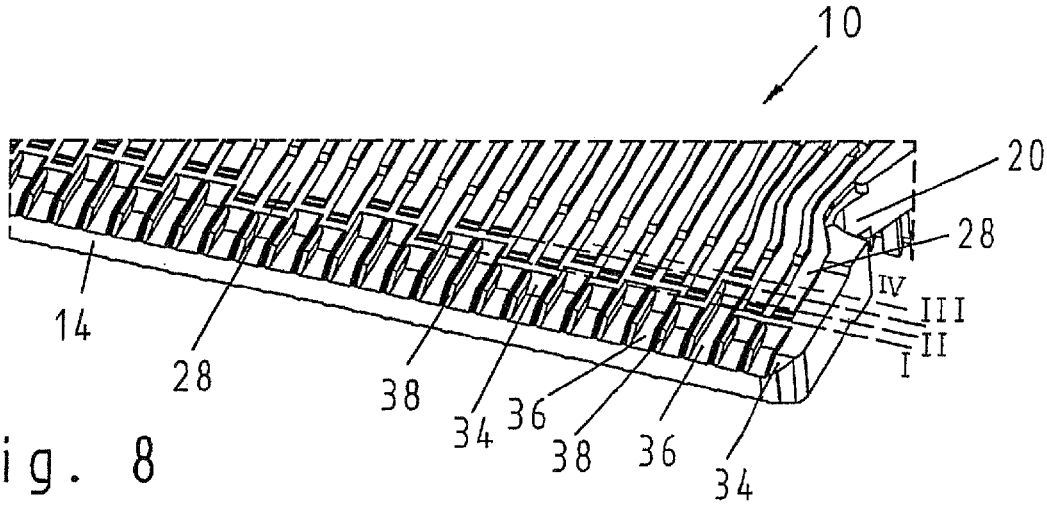
FIG. 8 is a detail view of the plug-side end of the circuit board connector extension.
Figure 9:
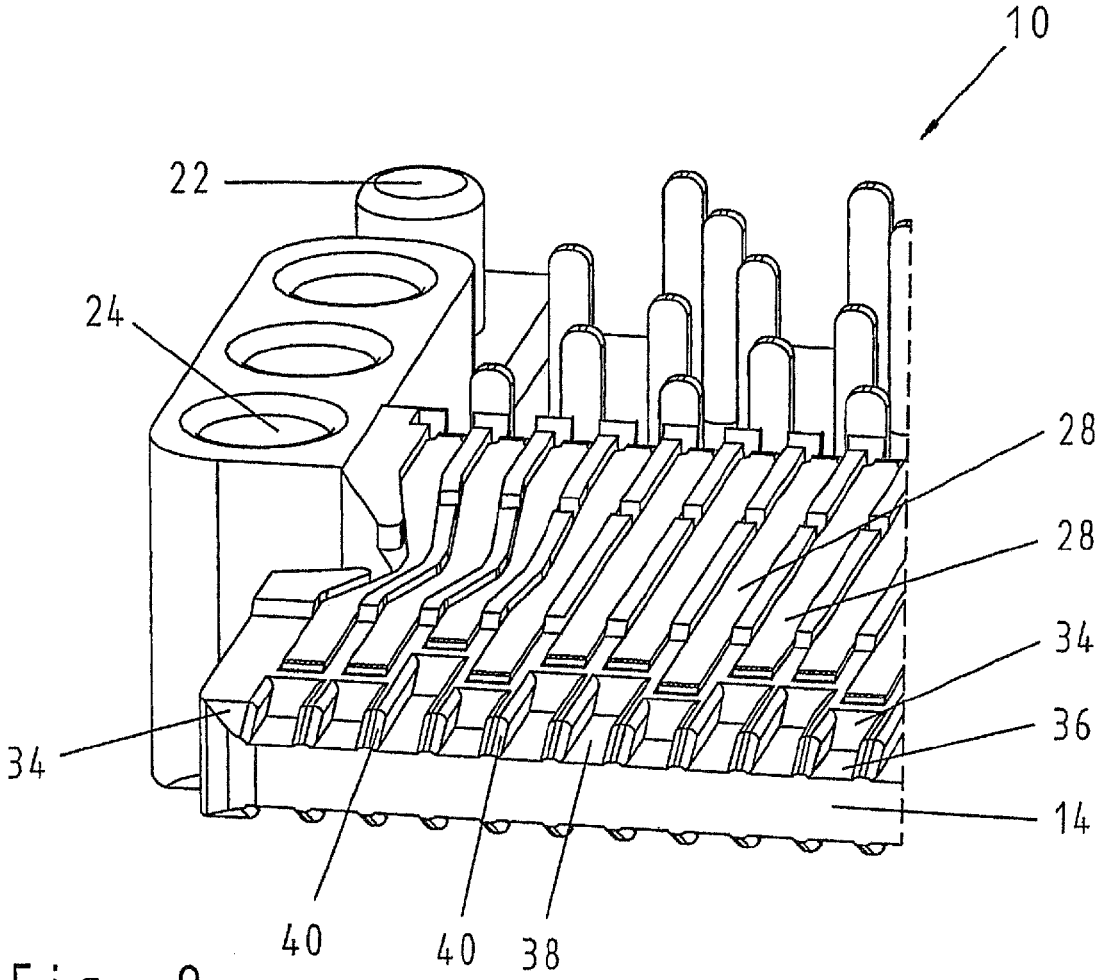
FIG. 9 shows, again on an enlarged scale, a detail of the plug-in side of the circuit board connector extension.

As can be clearly seen in FIG. 6 and in particular in FIGS. 8 to 9, the plug-in area 14 is beveled at its foremost end. To this end the plug-in area 14 comprises a chamfer 34 at its upper and lower sides. The chamfer 34 results in that the spring contacts of the connector assembly, into which the circuit board connector extension 10 is inserted, will be slowly deflected in outward direction during insertion. It is additionally provided that the plug-in ends 28 of the contacts end at differently staggered levels. As indicated in FIG. 8, the contacts end at different levels, with four levels I to IV being provided as shown here. The contacts beginning at the first level I preferably are used as ground contacts M.

Incisions 36 are provided in front of the plug-in ends 28 of those contacts which begin or end at the second or third level; in the case of two adjacent contacts beginning at the same level, these incisions are separated by a partition wall 38. Again, a chamfer 34 is provided at the rear end of each of the incisions 36. This design results in that the spring contacts of the connector assembly will be deflected during inserting the circuit board connector extension 10 at different points in time. In the process, the spring contacts which are to be deflected at a later point in time glide in the incisions 36 and will be directed through the partition walls 38, if any, as well as by pilot chamfers 40 provided at the front edge (see in particular FIG. 9) to the plug-in end of the contact associated to them.

Figure 7:
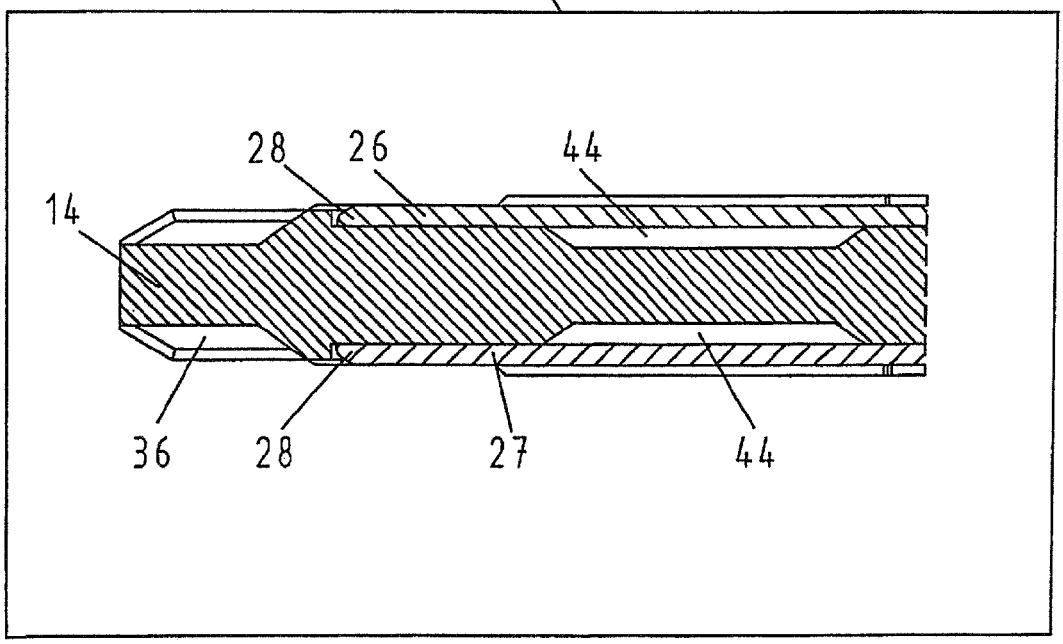
FIG. 7 shows on an enlarged scale a detail of FIG. 6.
Figure 10:
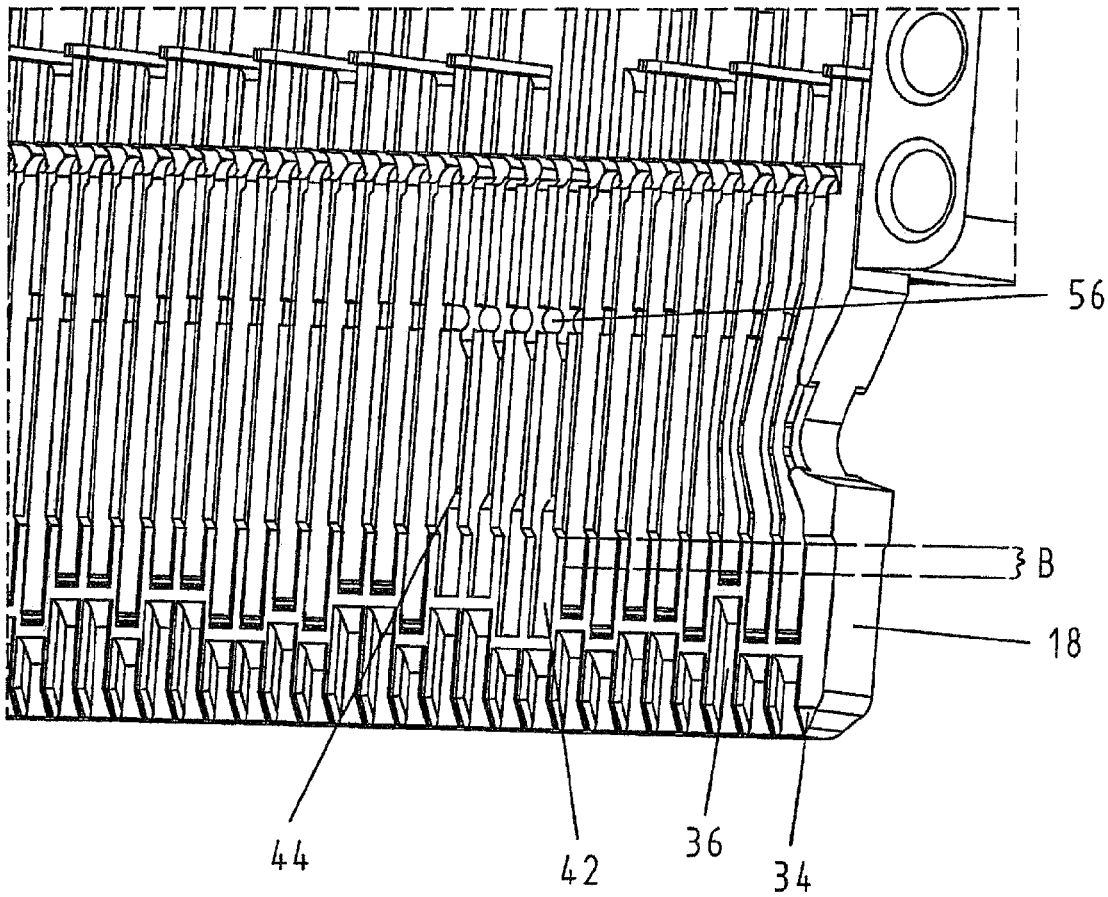
FIG. 10 is a bottom view of the plug-in side of the circuit board connector extension, some contacts having been removed.

The plug-in ends 28 of the contacts 26, 27 rest in suitable mounts 42 of the second bodies 18. Several air pockets 44 are provided underneath the plug-in ends 28 in the mounts 42 (see in particular FIGS. 7 and 10). On the one hand, the air pockets serve for adapting the impedance. On the other hand, they are advantageous for the correctly aligned, planar arrangement of the plug-in ends 28 in the mounts 42; it is simpler to specifically and partially support the plug-in ends 28 than to be forced to create a continuous, flat support surface. For the contacts which begin at the first level I, it is possible to arrange the pockets 44 still in front of the area in which the spring contacts of the connector assembly rest against the contacts, when the circuit board connector extension 10 is fully inserted in the connector assembly; this area is indicated in FIG. 10 with B.

Figure 11:
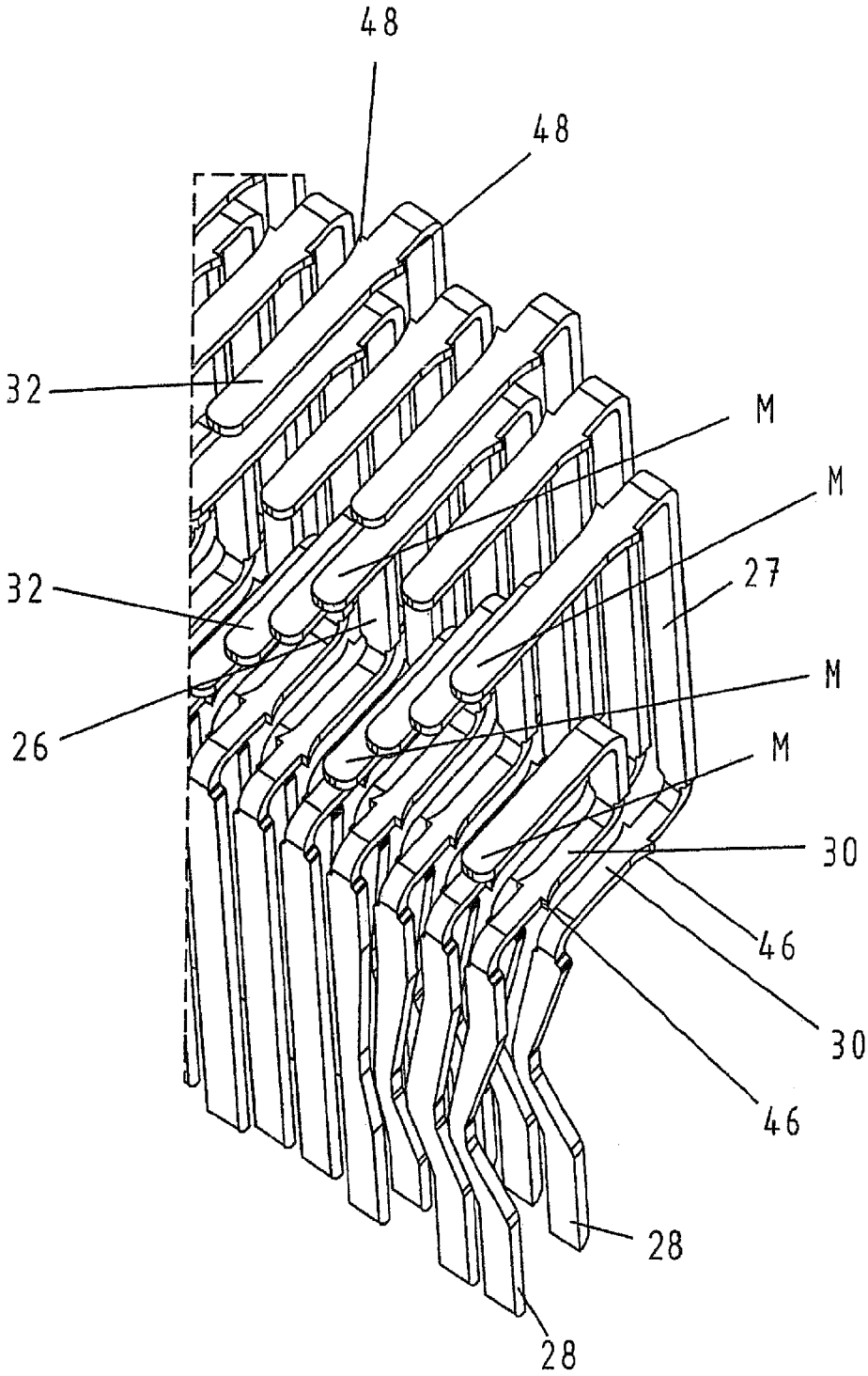
FIG. 11 shows a cutout of some contacts of the circuit board connector extension, with the body of the connector extension being not illustrated for clarification.
Figure 13:
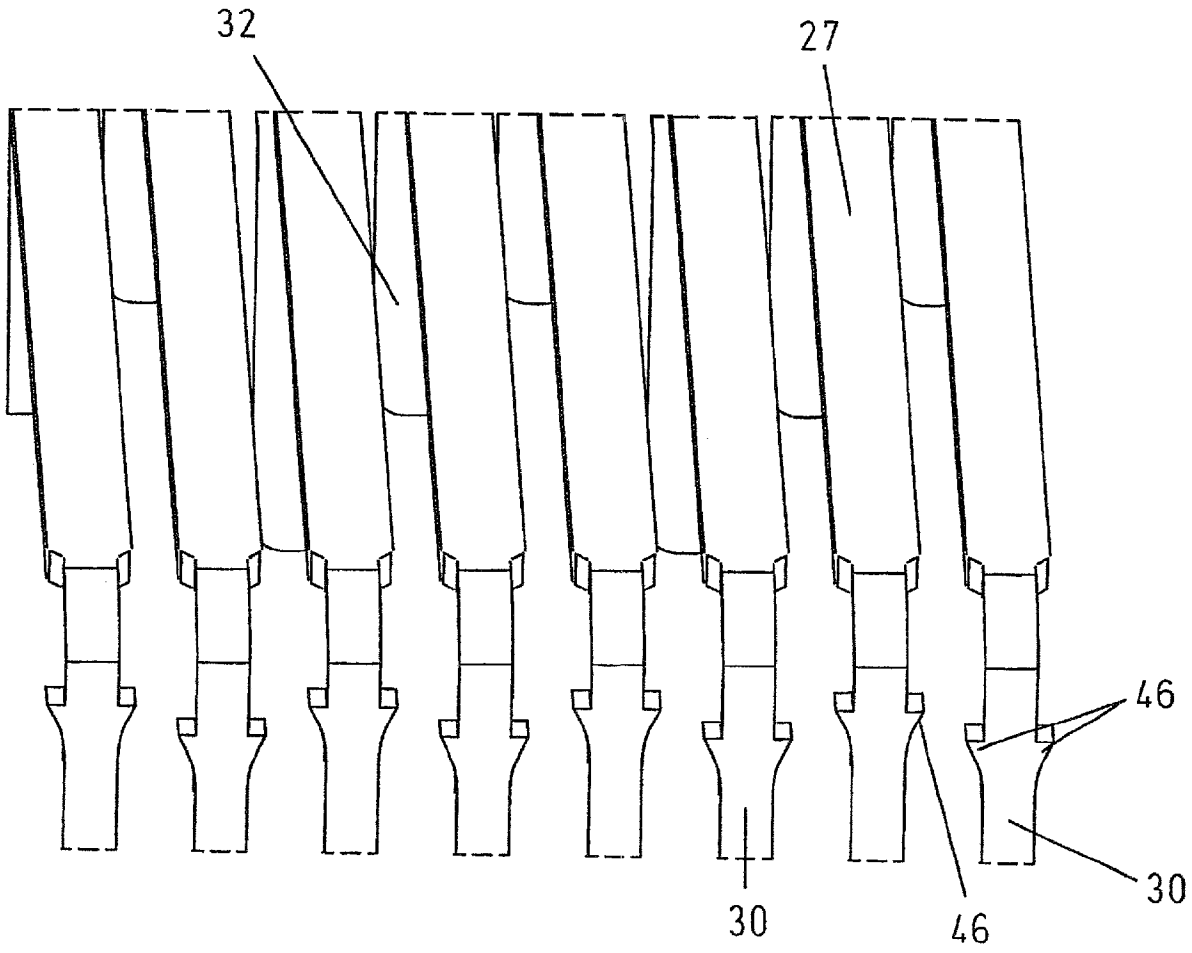
FIG. 13 shows on an enlarged scale a detail of the contacts.
Figure 12:
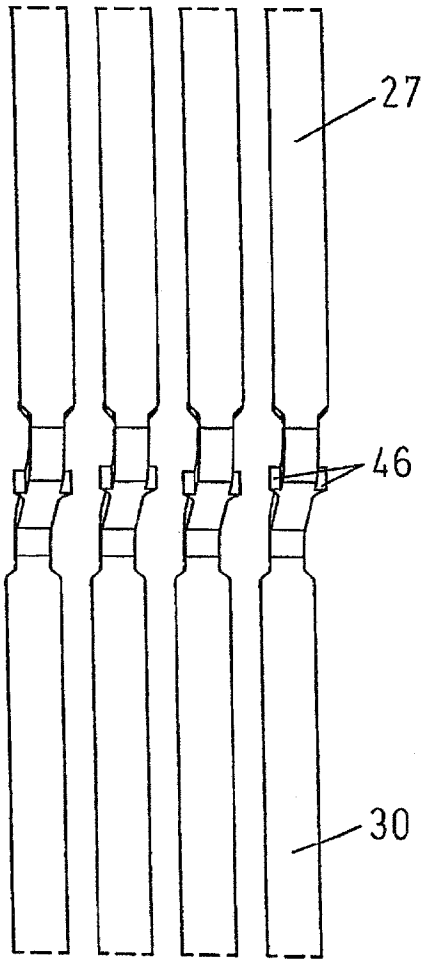
FIG. 12 shows the transition portion of some contacts.

In FIG. 11 the contacts 26, 27 can be seen. In this Figure one can clearly see that each of the contacts 26, 27 has two latching hooks 46 which are formed on opposite sides of the transition portions 30. These latching hooks can also be seen in FIGS. 12 and 13. As can be seen particularly well in FIG. 13, the latching hooks 46 of adjacent contacts of one group are arranged at different levels. Arranging the latching hooks at different levels has the advantage, on the one hand, that higher anchoring forces will appear in the body of the circuit board connector extension 10. If there is no need to retain the latching hook of the neighboring contact at the same level, more material will be available for the transmission of the holding forces. On the other hand, better values with respect to shielding will appear, because the minimum distance between the latching hook is larger if these are arranged at different levels. Further it is to be noted that the contacts in the transition portions are configured so as to have a reduced width. This can be clearly seen in FIGS. 12 and 13. This makes it possible to punch the latching hook out of the material width of the contact without being forced to assess an enlarged material width here. Through this measure the distance between the latching hooks of neighboring contacts is enlarged still more, bringing additional advantages in terms of holding force and shielding.

In addition to the latching hooks 46 on the transition portion, the contacts 27 of the second group in each case have two latching hooks 48 at opposite sides of the connecting end 32.

Figure 14:
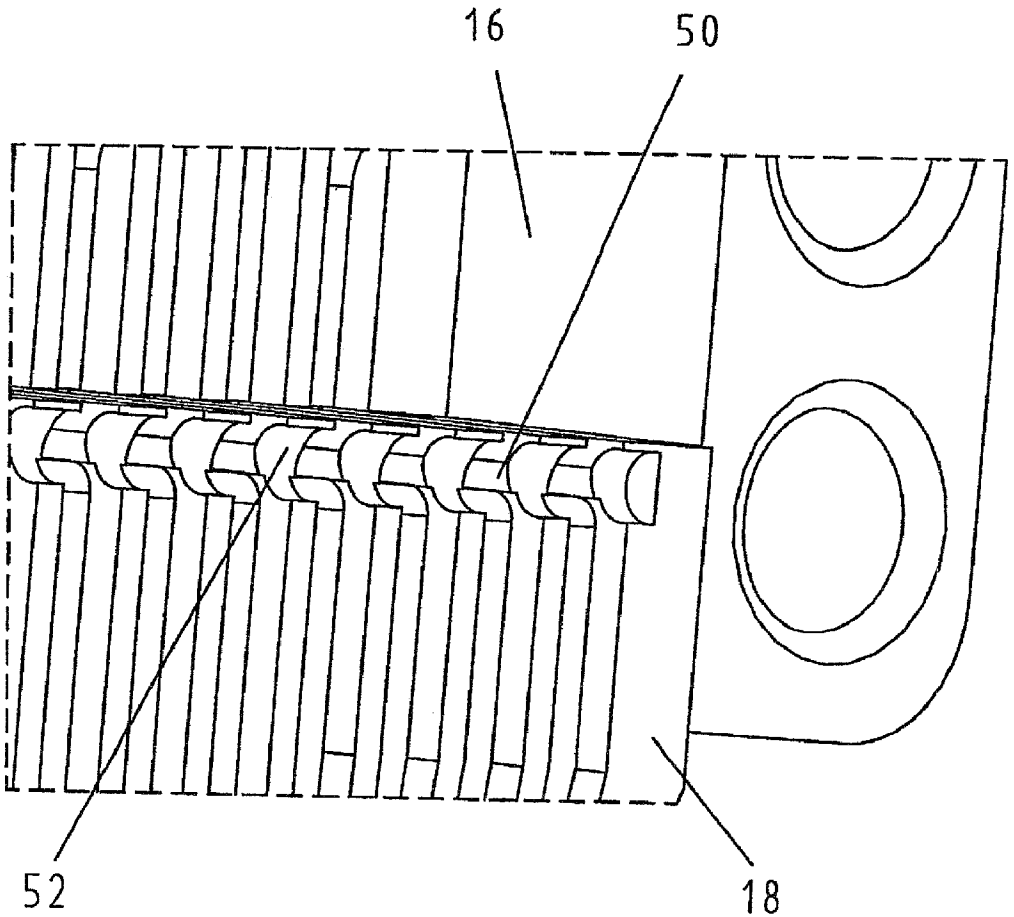
FIG. 14 shows a detail of the body of the circuit board connector extension, the contacts being not illustrated.
Figure 16:
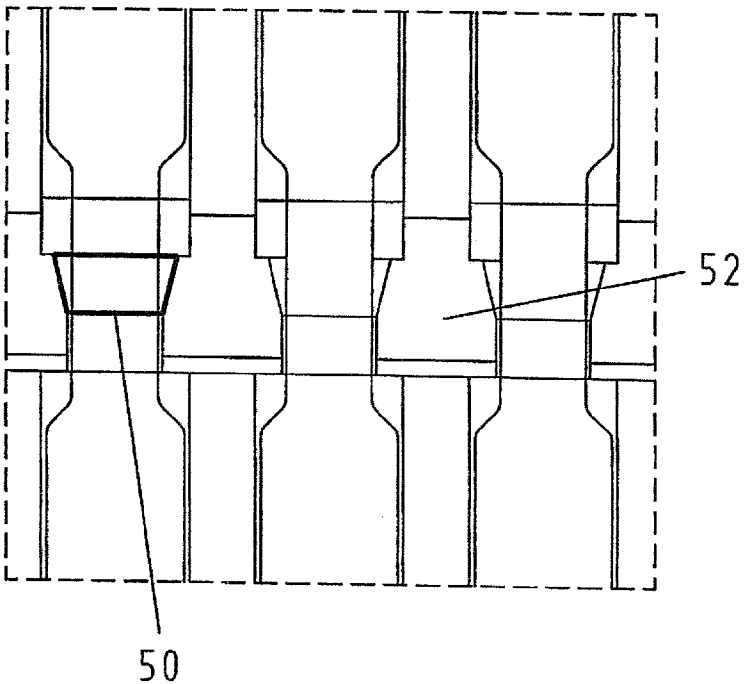
FIG. 16 shows in a detail view a top view of the assembled contacts.
Figure 15:
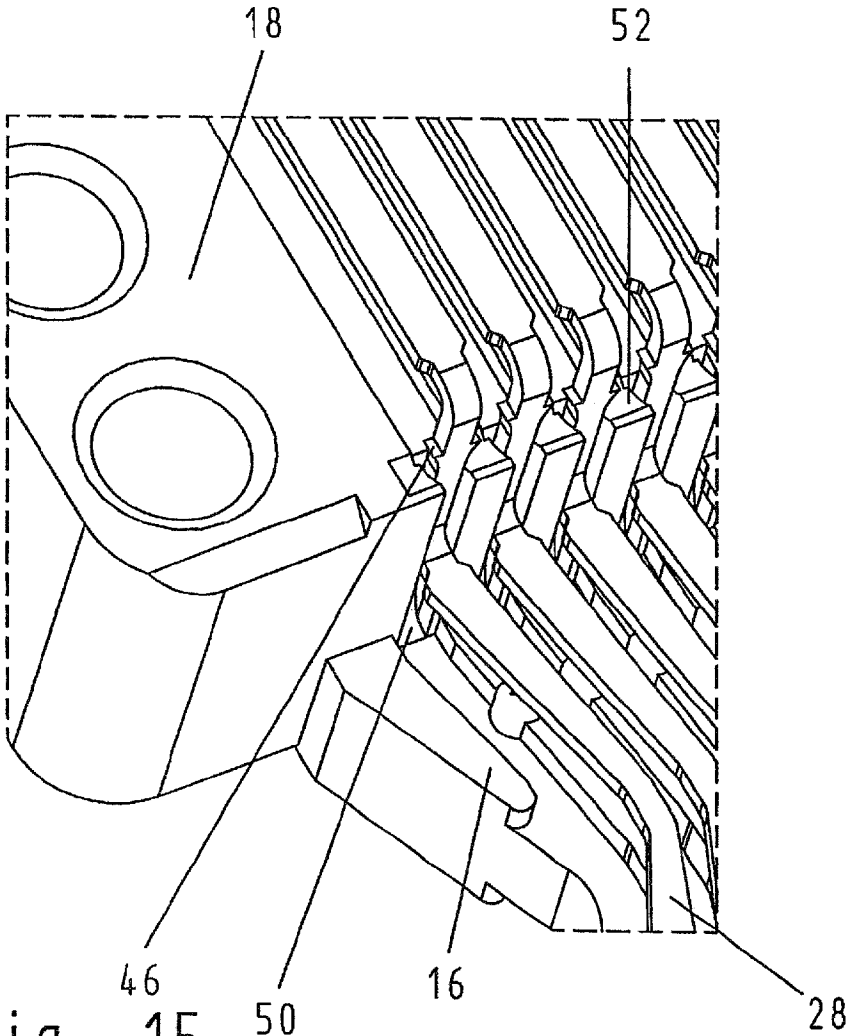
FIG. 15 shows on an enlarged scale a cutout of the circuit board connector extension, the contacts being pre-assembled.

Fastening the contacts 26, 27 to the sections 16, 18 of the circuit board connector extension 10 is performed essentially by means of a groove 50 formed at the transition from the first section 16 to the second section 18 on the side of the connecting area 12 (see in particular FIGS. 6, 14 and 15). The transition portions 30 of the contacts 26 of the first group and of the contacts 27 of the second group will be received in the grooves 50. As seen in cross-section, the groove 50 has the shape of a trapezoid drawn in FIG. 16. Due to the trapezoidal form the groove narrows towards outside, so that the transition portion 30 of the contacts 26, 27 is retained towards the sections 16 and 18, respectively.

Figure 17:
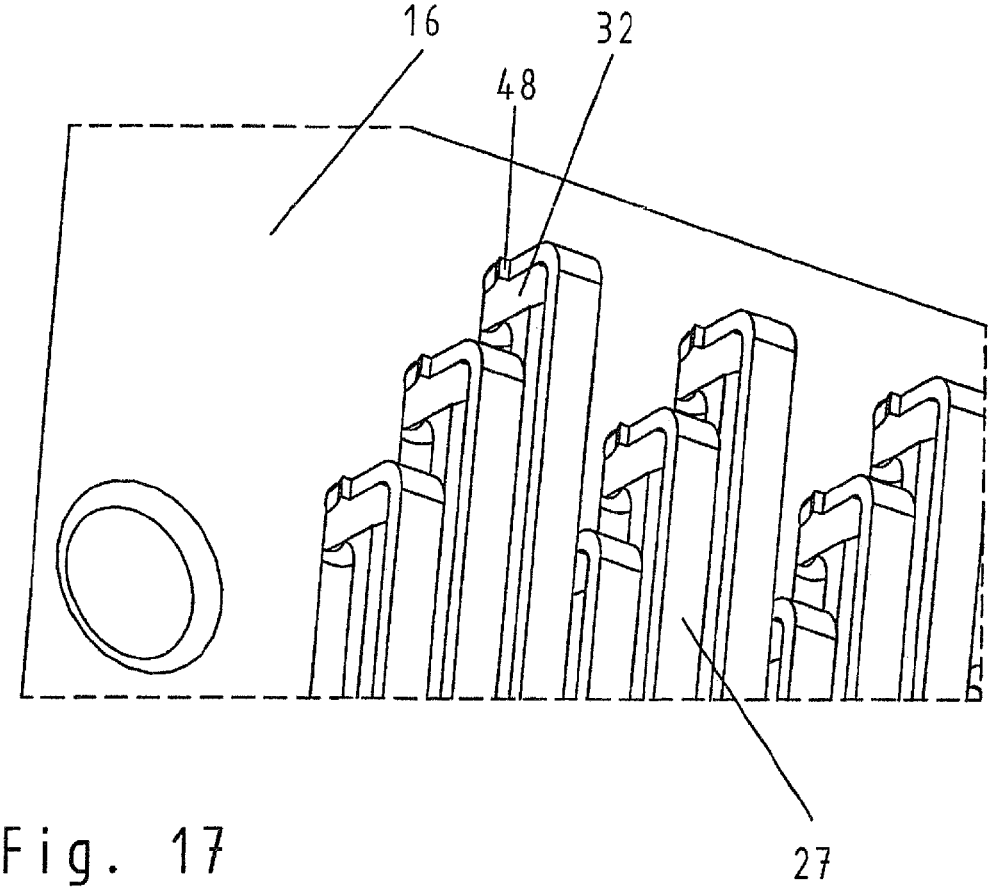
FIG. 17 shows in an enlarged detail view the connecting ends of some pre-assembled contacts.

On its upper side, starting from which the transition portions are inserted in the groove, each groove 50 has a pilot portion 52 configured as a concave chute. The bottom of the chute lies to the sides of the groove 50 in each case and has its deepest point roughly at the place where the transition portion 30 is to be situated after insertion. When the contacts are inserted with their transition portions into the grooves 50, the transition portions and in particular the latching hooks 46 are guided to the correct position by the pilot portions 52. The contacts will be pressed in to such an extent that the latching hooks 46 cut into the material of the corresponding section 16, 18 and anchor the transition portions at this place. At the same time the connecting ends 32 of the contacts 27 of the second group have to be pressed in such that the additional latching hooks 48 (see FIG. 17) cut into the material of the first sections 16.

For the purpose of correctly positioning the plug-in ends 28 of the contacts 26, 27, these are configured such that the angle α (see FIG. 6) between the plug-in ends 28 and the transition portions 30 is slightly larger than 90° for the contacts 27 of the second group, whereas the angle β between the plug-in ends 28 and the transition portions 30 of the contacts 26 of the first group is slightly smaller than 90°. If the transition portions 30 are pressed in in the direction of the arrows P of FIG. 6, angle β is bent open to 90°, whereas angle α is compressed to 90°. In both cases the plug-in ends 28 are elastically acted upon in the mounts 42, provided for them, in the first body 18 where they remain without any further measures.

With the arrangement of the contacts 26, 27 which is shown, it is possible to achieve in particular a very close arrangement of the contacts. For a common design variant the contacts are arranged in a step range of 0.75 mm. One can see from this how small the space is between the contacts which is available for their anchoring.

Figure 18:
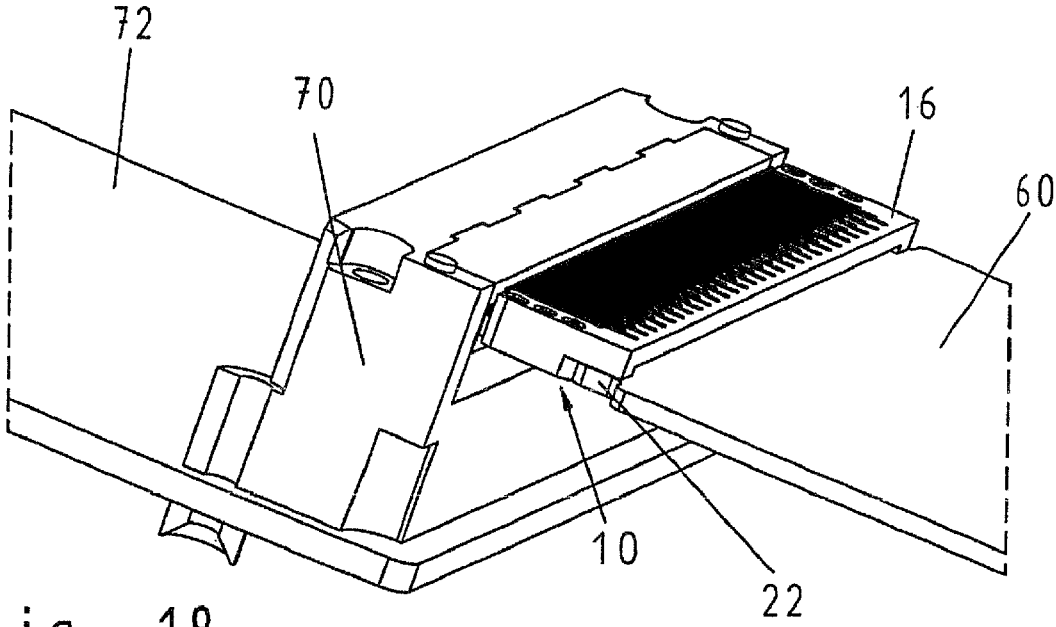
FIG. 18 shows in a perspective view a circuit board provided with a circuit board connector extension according to the invention, the latter in turn being inserted in a board edge connector assembly.
Figure 19:
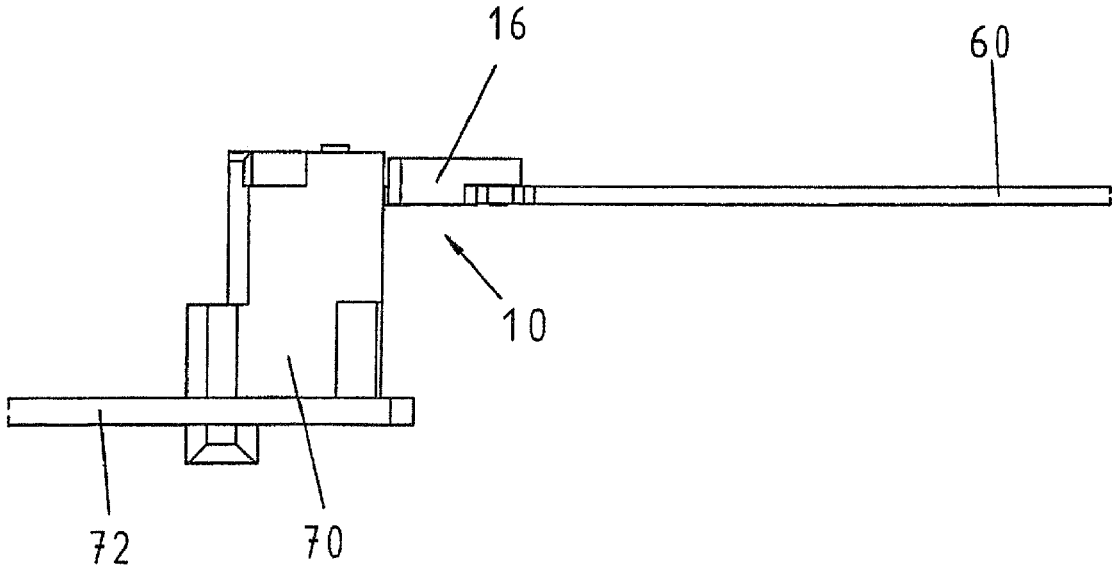
FIG. 19 shows in a side view the assembly unit of FIG. 18.
Figure 22:
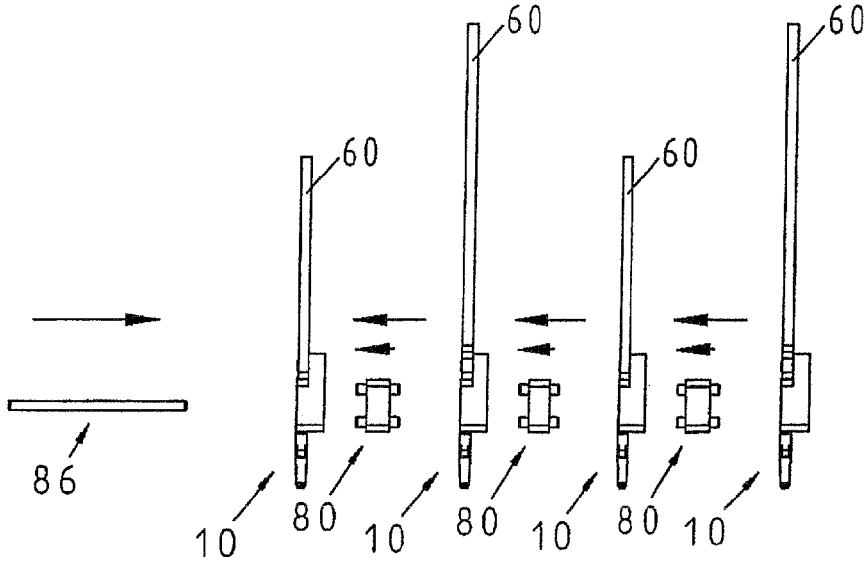
FIG. 22 shows in a schematic side view the circuit boards of the assembly unit of FIG. 20, which are not joined yet.
Figure 21:
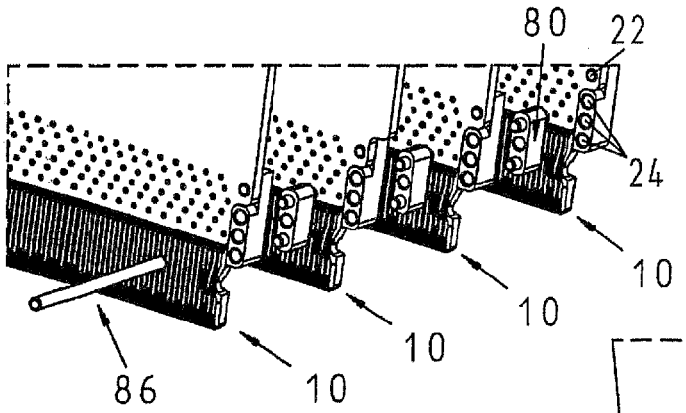
FIG. 21 shows in a perspective view the circuit boards shortly before being joined.

The circuit board connector extension 10 equipped with the contacts 26, 27 can be put onto the edge of a circuit board 60 (see FIGS. 18 and 19), the connecting ends 32 of the contacts 26, 27 being connected with corresponding conductor tracks of the circuit board 60. Here, the connecting ends 32 either can be soldered superficially, soldered in a recess or hole, or even can be pressed in. The additional latching hooks 48 of the contacts 27 of the second group ensure here that the connecting ends 32 of these contacts are not pushed out of the first section 16; the connecting ends 32 of the contacts 26 reliably rest against the first section 16 without any further measures. For positioning the circuit board connector extension 10 on the circuit board 60, the latter is provided with suitable holes which can be engaged by the positioning protrusions 22. Then, the circuit board 60 can be inserted with the circuit board connector extension 10 in a board edge connector assembly 70 which here is arranged on a further circuit board 72, for instance a backplane. The use of the circuit board connector extension 10 has the particular advantage that its plug-in area 14 can be realized with a very much larger precision than the edge area of a circuit board. Consequently, the contact forces occurring during inserting the circuit board connector extension 10 in the board edge connector assembly 70 can be controlled very much better.

Figure 20:
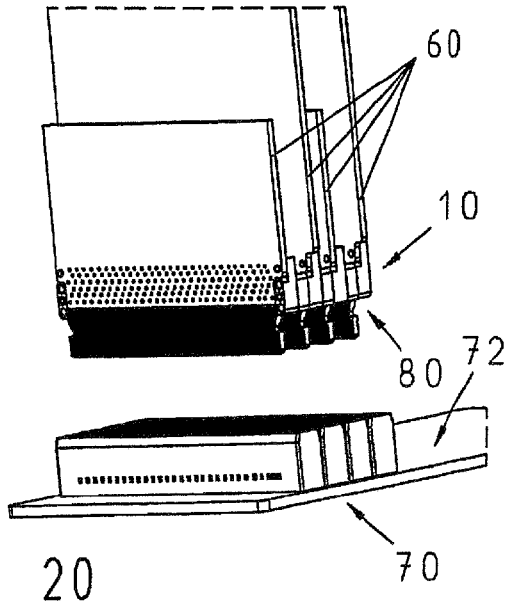
FIG. 20 shows in a perspective view another assembly unit which consists of several circuit boards with circuit board connector extensions attached thereto and is adapted to be inserted in board edge connector assemblies.
Figure 24:
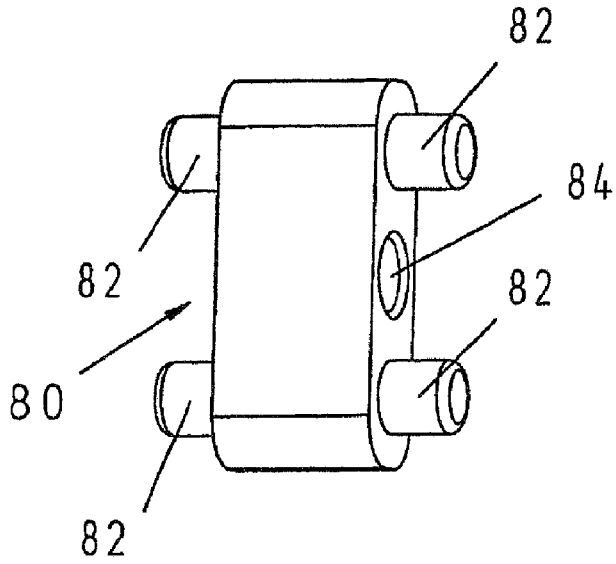
FIG. 24 shows in a perspective view a spacer used with the assembly unit of FIG. 21.

FIG. 20 shows an assembly unit which in the case shown consists of four circuit boards 60 connected with each other. For connecting the circuit boards, spacers 80 (see in particular FIG. 24) are used in each case between the circuit board connector extensions, which spacers have two retaining pins 82 at each of their sides. A positioning opening 84 extends centrally through each of the spacers 80. The position of the retaining pins 82 and the positioning openings 84 corresponds to the arrangement of the openings 24 on the circuit board connector extension 10.

Figure 23:
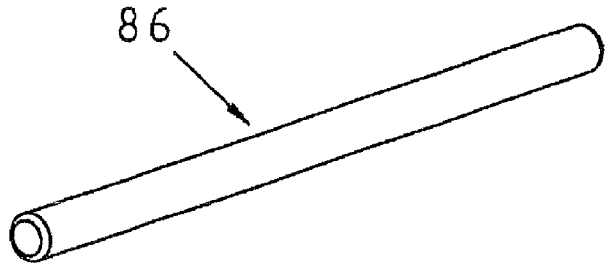
FIG. 23 shows in a perspective view a locating pin used with the assembly unit of FIG. 21.

For assembling the circuit boards 60 to an assembly unit the retaining pins 82 of the spacers 80 are inserted into the outer openings 24 of the circuit board connector extensions 60 arranged on the circuit boards 60. Next, a locating pin 86 (see FIG. 23) is pushed through the positioning opening 84 of the spacers 80 as well as through the central opening 24 of the circuit board connector extensions 10. In this way all components are precisely aligned relative to each other, so that the assembly unit made up of the several circuit boards 60 can be pushed into board edge connector assemblies 70 which are closely adjoining each other and are arranged on a further circuit board 72, for instance a backplane.

The precise positioning of the circuit board connector extensions 10 on the circuit boards 60 as well as their precise mutual alignment through the spacers 80 is particularly important, because some of the circuit boards 60 in most cases are guided in a (not illustrated) guide in such a manner that they can be properly pushed into the board edge connector assembly 70. If some of the circuit board connector extensions 10 are not correctly positioned, this results in alignment errors. The circuit boards 60 could be rotated relative to each other in the manner of a fan, for instance. In this case it is hardly possible to guide the circuit boards by means of the provided guides in a correct manner such that the circuit board connector extensions 10 exactly will meet the connector assemblies associated to them.

In order to ensure a precise positioning of the circuit board connector extensions 10 concerning their mutual distances, it is provided to realize the retaining pins 82 with such a length that they immediately abut against each other when the section 16—which as a matter of fact is arranged between them—is too small in thickness. In this way one can avoid the eventuality of arranging the spacers 80 with a mutual distance which would be too small, which again would result in an undersized distance between the individual circuit board connector extensions 10.

Figure 25:
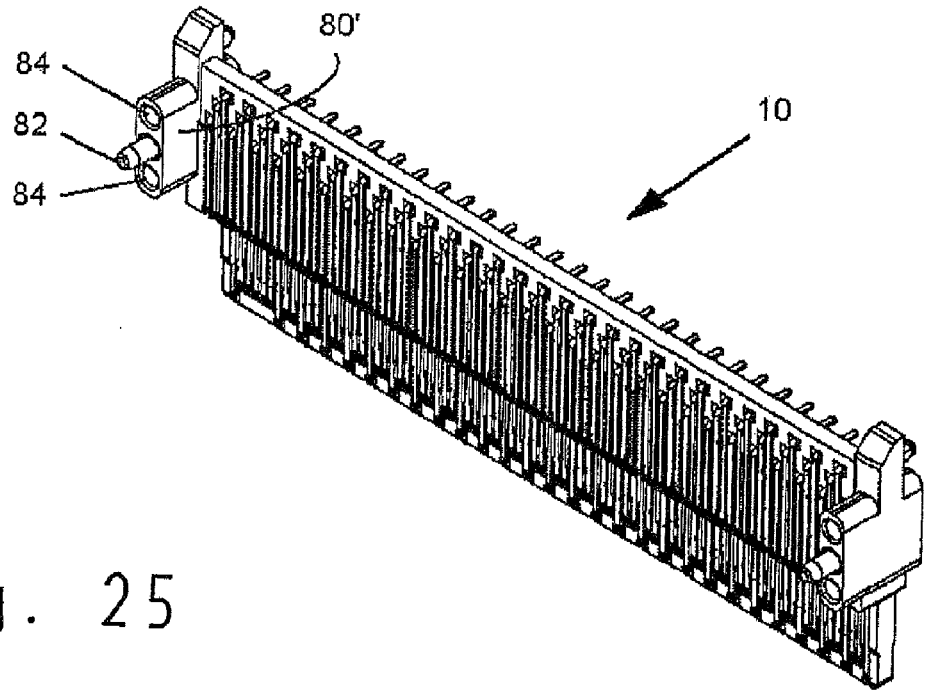
FIG. 25 shows in a perspective view a circuit board connector extension according to an alternative design.

FIG. 25 shows an alternative configuration in which the spacers 80' are integrally formed on the connector extensions 10. Each spacer 80 is provided here with a retaining pin 82 and two positioning openings 84. This one-piece design reduces the manufacturing and assembly expenses as well as the occurring tolerances.

FIGS. 26 to 29 show a connector extension according to an alternative design which differs from the connector extension shown in FIGS. 1 to 5 in this respect that the lateral contractions are dispensed with. Therefore it is not necessary to make the contacts follow an inward curve. Instead, all contacts can be configured so as to be straight.

LIST OF REFERENCE NUMERALS

10: circuit board connector extension
12: connecting area
14: plug-in area
16: first section
18: second section
20: contraction
22: positioning protrusion
24: opening
26: contacts of the first group
27: contacts of the second group
28: plug-in end
30: transition portion
32: connecting end
34: chamfer
36: incision
38: partition wall
40: pilot chamfer
42: recess
44: air pocket
46: latching hook
48: additional latching hook
50: groove
52: pilot portion
60: circuit board

70: board edge connector assembly
72: further circuit board
80: spacer
82: retaining pin
84: positioning opening
86: locating pin

The invention claimed is:

1. The circuit board connector extension configured to attach to a circuit board comprising a plastic body having two overlapping sections; and first and second groups of contacts coupled to the plastic body, each having a connecting end to contact conductor tracks on the circuit board and a plug-in end to couple with a connector piece, wherein the connecting ends of the two groups of contacts are arranged on one side of the plastic body and the plug-in end of the first group and the plug-in end of the second group are arranged on opposite sides of the body, wherein the two sections of the plastic body overlap such that the plug-in end of the connector extension is situated in the same plane as the circuit board, and such that each of the two groups of contacts are guided from the first section to the second section by a transition portion which is bent approximately at right angles, wherein the body between the first and second groups of contacts is provided with a group of punched openings which allow the contacts of each of the first and second groups of contacts to be blanked.

2. The circuit board connector extension according to claim 1, wherein the body has at least one positioning protrusion, upon which the connector extension can be inserted in a mount of the circuit board with an interlocking fit.

3. The circuit board connector extension according to claim 2, wherein the at least one positioning protrusion comprises a cylindrical pin.

4. The circuit board connector extension according to claim 1, wherein the body laterally has two contractions for locking in place in the connector piece.

5. The circuit board connector extension according to claim 1, wherein the contacts of the second group extend through the body.

6. The circuit board connector extension according to claim 1, wherein the plug-in ends of the contacts terminate at different levels.

7. The circuit board connector extension according to claim 6, wherein the body has a chamfer in front of each plug-in end.

8. The circuit board connector extension according to claim 7, wherein incisions are provided in front of those plug-in ends which end at a level beyond a level most proximal to the plug-in end.

9. The circuit board connector extension according to claim 8, wherein the incisions are provided with oblique pilot chamfers.

10. The circuit board connector extension according to claim 6, wherein incisions are provided in front of those plug-in ends which end at a level beyond a level most proximal to the plug-in end.

11. The circuit board connector extension according to claim 10, wherein the incisions are provided with oblique pilot chamfers.

12. The circuit board connector extension according to claim 6, wherein the plug-in ends of the contacts terminate at four different levels.

13. The circuit board connector extension according to claim 1, wherein air pockets are provided between each of the first and second contact groups and the body.

14. The circuit board connector extension according to claim 13, wherein each of the first and second contact groups are supported by the body in an area of contact with the connector piece.

15. The circuit board connector extension according to claim 14, wherein below the plug-in ends, a further air pocket is provided in front of the areas of the contact zone which are supported by the connector piece.

16. The circuit board connector extension according to claim 1, wherein the two sections are integrally formed with each other.

17. The circuit board connector extension according to claim 1, wherein the contacts of the second group are provided at the connecting end with at least one latching hook which can be pressed into the body.

18. The circuit board connector extension configured to attach to a circuit board comprising a plastic body having two overlapping sections; and first and second groups of contacts coupled to the plastic body, each having a connecting end to contact conductor tracks on the circuit board and a plug-in end to couple with a connector piece, wherein the connecting ends of the two groups of contacts are arranged on one side of the plastic body and the plug-in end of the first group and the plug-in end of the second group are arranged on opposite sides of the body, wherein the two sections of the plastic body overlap such that the plug-in end of the connector extension is situated in the same plane as the circuit board, and such that each of the two groups of contacts are guided from the first section to the second section by a transition portion which is bent approximately at right angles, wherein the transition portion is guided in a groove.

19. The circuit board connector extension according to claim 18, wherein the groove is provided with a pilot portion.

20. The circuit board connector extension according to claim 19, wherein the pilot portion has a concave shape.

21. The circuit board connector extension according to claim 20, wherein the pilot portion has a concave shape of a semi-circular chute.

22. The circuit board connector extension according to claim 18, wherein the groove has a trapezoidal cross-section.

23. The circuit board connector extension according to claim 18, wherein the groove guides the transition portion.

24. The circuit board connector extension according to claim 23, wherein for the first group of contacts the angle ($\beta$) between the transition portion and the plug-in end is slightly smaller than 90°, so that the plug-in end during pressing the contact into the body is clamped against the body.

25. The circuit board connector extension according to claim 23, wherein for the second group of contacts the angle ($\alpha$) between the transition portion and the plug-in end is slightly larger than 90°, so that the plug-in end during pressing the contact into the body is clamped against the body.

26. The circuit board connector extension according to claim 18, wherein the transition portion is fixed in the groove by at least one latching hook.

27. The circuit board connector extension according to claim 26, wherein the latching hooks of neighboring transition portions are at different levels.

28. The circuit board connector extension according to claim 27, wherein the transition portion is configured so as to have a reduced width and a contact in the region of the latching hook approximately has the remaining width.

29. The circuit board connector extension according to claim 26 wherein the transition portion is configured so as to have a reduced width and a contact in the region of the latching hook approximately has the remaining width.

30. An assembly unit comprising two or more connector extensions, each extension configured to attach to a circuit board comprising a plastic body having two overlapping sections; and first and second groups of contacts coupled to the plastic body, each having a connecting end to contact conductor tracks on the circuit board and a plug-in end to couple with a connector piece, wherein the connecting ends of the two groups of contacts are arranged on one side of the plastic body and the plug-in end of the first group and the plug-in end of the second group are arranged on opposite sides of the body, wherein the two sections of the plastic body overlap such that the plug-in end of the connector extension is situated in the same plane as the circuit board, and such that each of the two groups of contacts are guided from the first section to the second section by a transition portion which is bent approximately at right angles, wherein spacers are arranged between the connector extensions so as to be provided on the sides thereof, and one locating pin each extending through the spacers and the lateral areas of the connector extensions.

31. The assembly unit according to claim 30, wherein the spacers are integrally formed on the circuit board connector extensions.

32. The circuit board connector extension configured to attach to a circuit board comprising a plastic body having two overlapping sections; and first and second groups of contacts coupled to the plastic body, each having a connecting end to contact conductor tracks on the circuit board and a plug-in end to couple with a connector piece, wherein the connecting ends of the two groups of contacts are arranged on one side of the plastic body and the plug-in end of the first group and the plug-in end of the second group are arranged on opposite sides of the body, wherein the two sections of the plastic body overlap such that the plug-in end of the connector extension is situated in the same plane as the circuit board, and such that each of the two groups of contacts are guided from the first section to the second section by a transition portion which is bent approximately at right angles, wherein the two sections are integrally formed with each other, and wherein the transition portion is guided in a groove.

33. The circuit board connector extension according to claim 32, wherein the groove is provided with a pilot portion.

34. The circuit board connector extension according to claim 33, wherein the pilot portion has a concave shape.

35. The circuit board connector extension according to claim 34, wherein the pilot portion has a concave shape of a semi-circular chute.

* * * * *